US009375779B2

(12) United States Patent
Bieg et al.

(10) Patent No.: US 9,375,779 B2
(45) Date of Patent: Jun. 28, 2016

(54) HORIZONTAL FORGING PRESS FOR MASSIVE FORMING

(71) Applicant: SCHULER PRESSEN GMBH, Göppingen (DE)

(72) Inventors: Markus Bieg, Ebenweiler (DE); Gerhard Vögel, Sigmarszell (DE)

(73) Assignee: Schuler Pressen GmbH, Goppingen (DE)

( * ) Notice: Subject to any disclaimer, the term of this patent is extended or adjusted under 35 U.S.C. 154(b) by 0 days.

(21) Appl. No.: 14/516,960

(22) Filed: Oct. 17, 2014

(65) Prior Publication Data

US 2015/0082852 A1 Mar. 26, 2015

Related U.S. Application Data

(63) Continuation of application No. PCT/EP2013/001163, filed on Apr. 19, 2013.

(30) Foreign Application Priority Data

Apr. 26, 2012 (DE) ..... 10 2012 008 180

(51) Int. Cl.

| | |
|---|---|
| ***B21J 9/00*** | (2006.01) |
| ***B21J 9/18*** | (2006.01) |
| ***B21J 9/02*** | (2006.01) |
| ***B30B 1/26*** | (2006.01) |
| ***B30B 15/02*** | (2006.01) |

(Continued)

(52) U.S. Cl.

CPC .... *B21J 9/18* (2013.01); *B21J 9/02* (2013.01); *B21J 9/022* (2013.01); *B21J 13/04* (2013.01); *B30B 1/26* (2013.01); *B30B 15/02* (2013.01); *B30B 15/282* (2013.01)

(58) Field of Classification Search

CPC ..... B21J 5/08; B21J 9/02; B21J 9/022; B21J 9/06; B21J 9/18; B30B 1/268

See application file for complete search history.

(56) References Cited

U.S. PATENT DOCUMENTS

2002/0157442 A1 10/2002 Petersen

FOREIGN PATENT DOCUMENTS

| | | |
|---|---|---|
| CH | 292 150 A | 7/1953 |
| DE | 495 868 C | 4/1930 |
| DE | 686 823 C | 7/1940 |

(Continued)

OTHER PUBLICATIONS

"Upgrade," Journal for Customers, Partners and Employees, 12th. year, Issue No. 23, Dec. 2009.

(Continued)

*Primary Examiner* — Debra Sullivan
(74) *Attorney, Agent, or Firm* — Burr & Brown, PLLC

(57) ABSTRACT

The invention relates to a horizontal forging press for massive forming, which comprises a machine frame, a forging ram, a clamping ram, at least a first force transmission device, at least a second force transmission device, and a multipart forging tool, wherein each force transmission device comprises at least one drive. The first force transmission device of the forging ram is here configured as a stroke-controlled force transmission device, and the second force transmission device of the clamping ram is here configured as a stroke-controlled force transmission device or as an energy-controlled force transmission device.

7 Claims, 8 Drawing Sheets

(51) Int. Cl.
*B30B 15/28* (2006.01)
*B21J 13/04* (2006.01)

(56) References Cited

FOREIGN PATENT DOCUMENTS

| | | | |
|---|---|---|---|
| DE | 948 381 | C | 8/1956 |
| DE | 949 018 | B | 9/1956 |
| DE | 1 826 030 | U | 2/1961 |
| DE | 2 053 279 | A1 | 6/1971 |
| DE | 77 21 553 | U1 | 8/1980 |
| GB | 1 579 423 | A | 11/1980 |
| GB | 2 069 901 | A | 9/1981 |
| JP | 2005-028440 | A1 | 2/2005 |

OTHER PUBLICATIONS

German Office Action (Application No. 10 2012 008 180.4) dated Jan. 3, 2013.
International Search Report and Written Opinion (PCT/EP2013/001163) dated Jul. 5, 2013.

HORIZONTAL FORGING PRESS FOR MASSIVE FORMING

CROSS REFERENCE TO RELATED APPLICATION

This application is a continuation of International Application No. PCT/EP2013/001163 filed Apr. 19, 2013, which designated the United States, and claims the benefit under 35 USC §119(a)-(d) of German Application No. 10 2012 008 180.4 filed Apr. 26, 2012, the entireties of which are incorporated herein by reference.

FIELD OF THE INVENTION

The invention relates to a horizontal forging press for massive forming.

BACKGROUND OF THE INVENTION

From the corporate publication "Upgrade—Journal for customers, partners and employees—12th. year, issue no. 23, Dec. 2009," a hydraulic horizontal forging machine is known, which machine comprises a machine frame, a forging ram for executing a horizontal forging motion, a clamping ram for executing a clamping motion oriented rotated through 90° relative to the forging motion, at least a first force transmission device for executing the forging motion of the forging ram, at least a second force transmission device for executing the clamping motion of the clamping ram, and a multipart forging tool having a first clamping jaw and a second clamping jaw, wherein each force transmission device comprises at least one drive. Disadvantages of a machine of this type are the high maintenance requirement for the hydraulics, the relatively low cycle speed and the comparatively long pressure dwell times.

SUMMARY OF THE INVENTION

The object of the invention is to propose a horizontal forging press for massive forming which has a low maintenance requirement, which is suitable for high cycle speeds, and which has short pressure dwell times.

In the inventive horizontal forging press for massive forming, a first force transmission device of the forging ram is configured as a stroke-controlled force transmission device, and a second force transmission device of the clamping ram is configured as a stroke-controlled or as an energy-controlled force transmission device. Such a configuration of the horizontal forging press is manageable through the use of robust and durable force transmission devices having a low maintenance requirement. With an inventive choice of force transmission devices, fast cycle rates can also be achieved through short time spans for the reversal of motion and short travel times. Furthermore, with a stroke-controlled force transmission device, combined with simple forging methods, very short pressure dwell times can be realized. The core of the present invention is thus a horizontal forging press having a multipart forging tool, in which the movement of two tool parts is effected by respectively a mechanical force transmission device which is optimally suited to the motional profile of the respective tool part. As a result, the different requirements of the two moving tool parts can be optimally met.

The present invention provides, in particular, to configure the first force transmission device, which moves the forging ram, as a crank mechanism or as a toggle mechanism or as an eccentric mechanism. All three drive forms guarantee the short pressure dwell time which is advantageous for the forging. In a really preferred manner, a crank mechanism which is particularly robust is provided for the forging.

The present invention also provides, in respect of the multipart forging tool, to connect the first clamping jaw to the clamping ram, to connect the second clamping jaw to the machine frame, to connect a forging jaw to the forging ram, and to arrange the first clamping jaw, in particular, above or beside the second clamping jaw. It is hereby possible to operate the first clamping jaw and the forging jaw fully independently of each other.

The present invention further provides to equip the first force transmission device of the forging ram with a first spring and/or damping unit, wherein the first spring and/or damping unit is disposed, in particular, in a drive train acting on the forging jaw. As a result, an effective protection from overload is created and, at the same time, the force transmission device also acquires characteristics of a force-controlled force transmission device. It thus intrinsically combines those characteristics of a stroke-controlled force transmission device which are positive for the forging and those characteristics of a force-controlled force transmission device which are positive for the forging, so that, on the one hand, short pressure dwell times and a high cycle rate and, on the other hand, an overload protection is given.

The present invention also provides, in particular, to configure the second force transmission device of the clamping ram either as a crank mechanism or as a toggle mechanism or as an eccentric mechanism, or to configure the second force transmission device of the clamping ram as a spindle drive. All four drive forms guarantee the short cycle times which are advantageous for the clamping or forging. In a really preferred manner, a crank mechanism which is particularly robust and by which a high clamping force is obtainable with simple design means is provided for the clamping.

The present invention further provides to equip the second force transmission device of the clamping ram with a second spring and/or damping unit, wherein the second spring and/or damping unit is disposed, in particular, in a drive train acting on the first clamping jaw. As a result, an effective protection from overload is created and, at the same time, the force transmission device also becomes a force-controlled force transmission device, which intrinsically combines those characteristics of a stroke-controlled or energy-controlled force transmission device which are positive for the clamping and those characteristics of a force-controlled force transmission device which are positive for the clamping, so that, on the one hand, high clamping forces and high cycle rates and, on the other hand, overload protection is given.

According to the present invention, it is provided to orient a drive axis of the first drive parallel to a drive axis of the second drive, wherein these two drive axes are arranged horizontally and lie respectively rotated through 90° in relation to a forging axis. As a result, in particular where stroke-controlled force transmission devices are used for the forging ram and the first clamping jaw, a particularly compact structure of the horizontal forging press is possible, since all used levers or cranks of the force transmission devices can be disposed in parallel planes.

In accordance with the present invention, the drive of the first force transmission device comprises at least one servomotor, and/or the drive of the second force transmission device comprises at least one servomotor. A simple control or regulation of the horizontal forging press is hence possible in all operating situations.

The present invention also provides to equip the multipart forging tool of the horizontal forging press between the two clamping jaws with at least two forging locations, which are successively passed through by a workpiece, wherein the workpiece is formed at each forging location by the forging jaw. With the horizontal forging press, multistep forging operations also can hence be performed, wherein the horizontal forging press, where a forging tool having a plurality of forging locations is used, also comprises a transfer device, which conveys the workpieces from forging location to forging location and, in particular, also inserts a blank into the first forging location and, in particular, also removes the multi-forged workpiece from the last forging location.

Finally, the present invention provides to configure the first spring and/or damping unit and/or the second spring and/or damping unit as a hydraulic cushion or as a pneumatic cushion or as a mechanical spring element. Spring and/or damping units of this type can be easily realized with standard components.

BRIEF DESCRIPTION OF THE DRAWINGS

Further details of the present invention are described in the drawing on the basis of schematically represented illustrative embodiments, wherein.

DETAILED DESCRIPTION OF THE INVENTION

Figure 1:
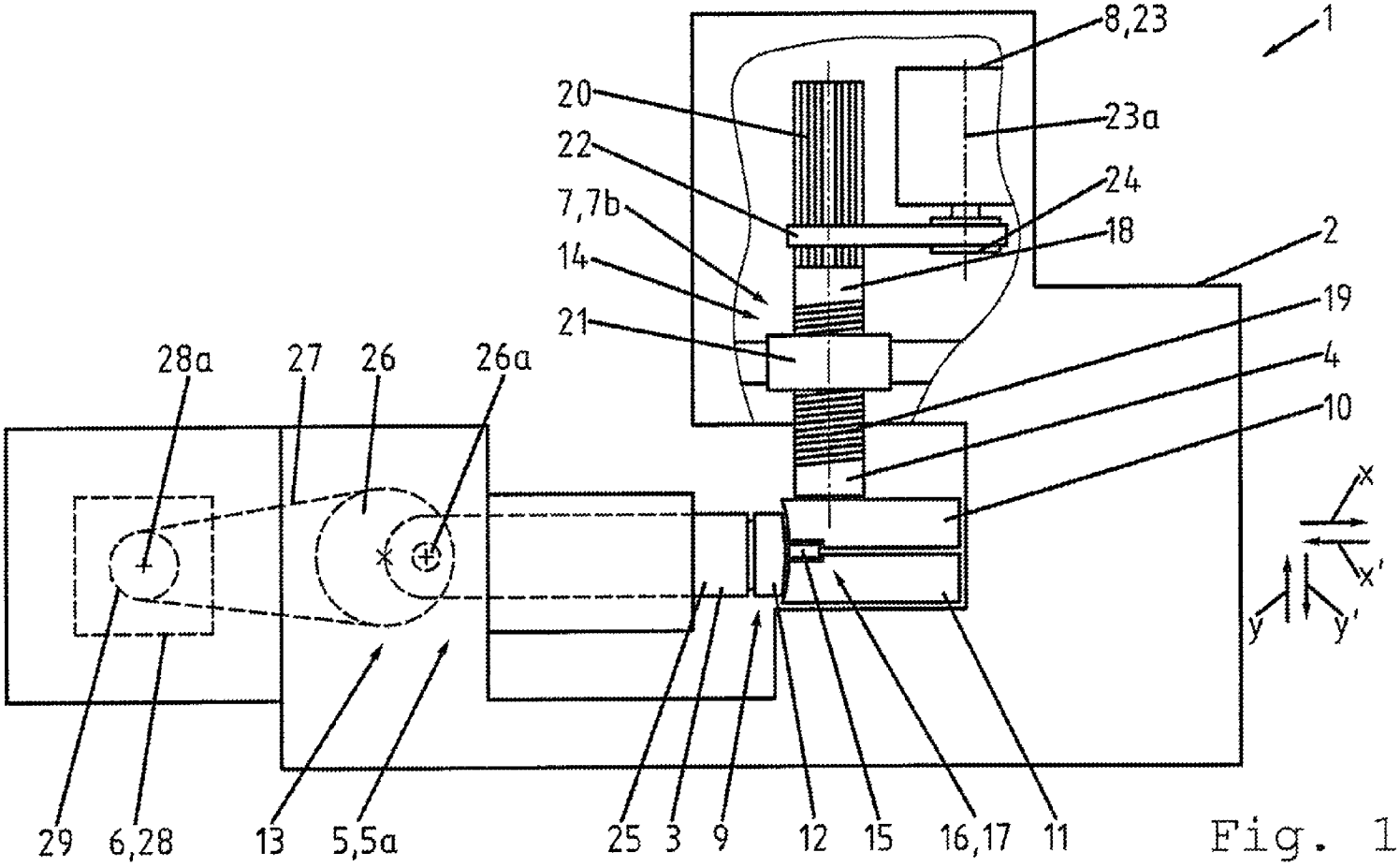
FIG. 1 shows a schematic side view of a first construction variant of a horizontal forging press.

In FIG. 1, a schematic side view of a first construction variant of a horizontal forging press 1 is shown. The horizontal forging press 1 comprises a machine frame 2, a forging ram 3 for executing a horizontal forging motion or working motion in an arrow direction x, a clamping ram 4 for executing a vertical clamping motion or working motion in an arrow direction y', a first force transmission device 5 for moving the forging ram 3, which device is driven by a first drive 6, a second force transmission device 7 for moving the clamping ram 4, which device is driven by a second drive 8, and a multipart forging tool 9. The multipart forging tool 9 is configured as a three-part forging tool 9 having a first, upper clamping jaw 10, a second, lower clamping jaw 11, and a forging jaw 12. The first force transmission device 5 for the forging ram 3 is here configured as a stroke-controlled force transmission device 5*a* and formed by a crank mechanism 13. The second force transmission device 7 for the clamping ram 4 is here configured as an energy-controlled force transmission device 7*b* and formed by a spindle mechanism 14. The forging jaw 12 of the forging tool 9 is connected to the forging ram 3 and is moved by this, in a forging blow or an upsetting motion, in the arrow direction x. A return stroke is made horizontally in an arrow direction x'. The first, upper clamping jaw 10 of the forging tool 9 is connected to the clamping ram 4 and is driven by the latter vertically downward in the arrow direction y' in order to clamp a workpiece 15 in a workpiece receiving space which is formed between the two clamping jaws 10, 11 and forms a forging location 17. In order to release the workpiece 15, the first, upper clamping jaw 10 is driven by the clamping ram 4 vertically upward in an arrow direction y. The clamping ram 4 is realized as a spindle 18, which comprises a thread 19 and a toothing 20. For the mounting of the spindle 18, the second force transmission device 7 comprises a spindle nut 21, which is fixed in a rotationally secure manner to the machine frame 2 and in which the spindle 18 moves upward or downward in dependence on a direction of rotation in which said spindle is driven in the region of its toothing 20 via a toothed belt 22 of the force transmission device 7. The drive of the toothed belt 22 is here effected by the second drive 8, configured as a servomotor 23, via a belt pulley 24 which rotates about a drive axis 23*a*. The forging ram 3 is configured as a rod 25 or crank rod, which is moved by a crank disk 26 of the first transmission device 5. The crank disk 26, with an eccentrically disposed crankpin 26*a* to which the rod 25 is coupled, is here driven, via a belt 27 belonging to the first force transmission device 5, by a belt pulley 29 connected to the first drive 6 configured as a servomotor 28. To this end, the belt pulley rotates about a drive axis 28*a* of the drive 6. In the position in which the horizontal forging press 1 is shown in FIG. 1, the workpiece 15 is clamped between the two clamping jaws 10 and 11 and the forging jaw 12 has deformed the workpiece and stands precisely at its reversal point so as to, after a forward motion in the arrow direction x, move back in the arrow direction x'.

Figure 2:
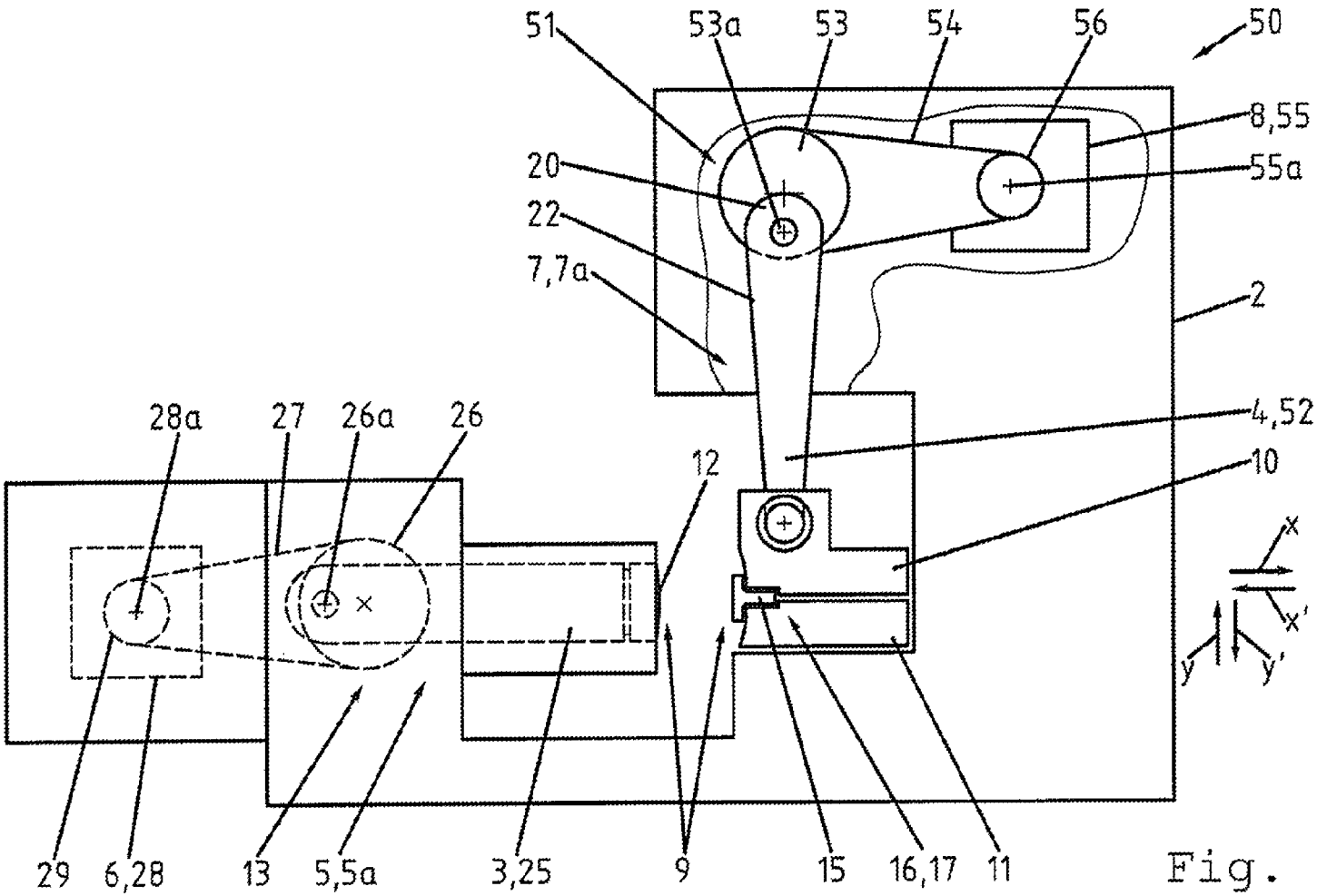
FIG. 2 shows a schematic side view of a second construction variant of a horizontal forging press.

In FIG. 2, a schematic side view of a second construction variant of a horizontal forging press 50 is shown. The horizontal forging press 50 comprises a machine frame 2, a forging ram 3 for executing a horizontal forging motion in an arrow direction x, a clamping ram 4 for executing a vertical clamping motion in an arrow direction y', a first force transmission device 5 for moving the forging ram 3, which device is driven by a first drive 6, a second force transmission device 7 for moving the clamping ram 4, which device is driven by a second drive 8, and a three-part forging tool 9 having a first, upper clamping jaw 10, a second, lower clamping jaw 11 and a forging jaw 12. The first force transmission device 5 for the forging ram 3 is here configured as a stroke-controlled force transmission device 5*b* and formed by a crank mechanism 13. The second force transmission device 7 for the clamping ram 4 is here configured as a stroke-controlled force transmission device 7*a* and formed by a crank mechanism 51. The forging jaw 12 of the forging tool 9 is connected to the forging ram 3 and is moved by this, in a forging blow or an upsetting motion, in the arrow direction x. A return stroke is made horizontally in an arrow direction x'. The first, upper clamping jaw 10 of the forging tool 9 is connected to the clamping ram 4 and is driven by the latter vertically downward in the arrow direction y', until reaching the position shown in FIG. 2, in order to clamp a workpiece 15 in a workpiece receiving space 16 which forms a forging location 17. In order to release the workpiece 15, the first, upper clamping jaw is driven by the clamping ram 4 vertically upward in an arrow direction y. To this end, the upper clamping jaw 10 is guided in vertical guides (not represented). The lower clamping jaw 11 is fixed to the machine frame 2. The clamping ram 4 is realized as a rod 52 or crank rod, which is moved by a crank disk 53 of the second force transmission device 7. The crank disk 53, with an eccentrically disposed crankpin 53*a* to which the rod 25 is coupled, is here driven, via a belt 54 belonging to the second force transmission device 7, by a belt pulley 56 connected to the second drive 8 configured as a servomotor 55. To this end, the belt pulley 56 rotates about a drive axis 55*a* of the drive 8. The forging ram 3 is configured as a rod 25 or crank rod, which is moved by a crank disk 26 of the first force transmission device 5. The crank disk 26 is here driven with an eccentrically disposed crankpin 26*a*, to which the rod 25 is coupled, via a belt 27 belonging to the first force transmission device 5, by a belt pulley 29 connected to the first drive 6 configured as a servomotor 28. To this end, the belt pulley 29 rotates about a drive axis 28*a* of the drive 6. In the position in which the horizontal forging press 1 is shown in FIG. 2, the as yet undeformed workpiece 15 is clamped between the two clamping jaws 10 and 11, and the rod 25, which bears the forging jaw 12, stands at a rear reversal point in order to drive the forging jaw 12 in an onward motion in the arrow direction x toward the as yet undeformed workpiece 15.

Figure 3:
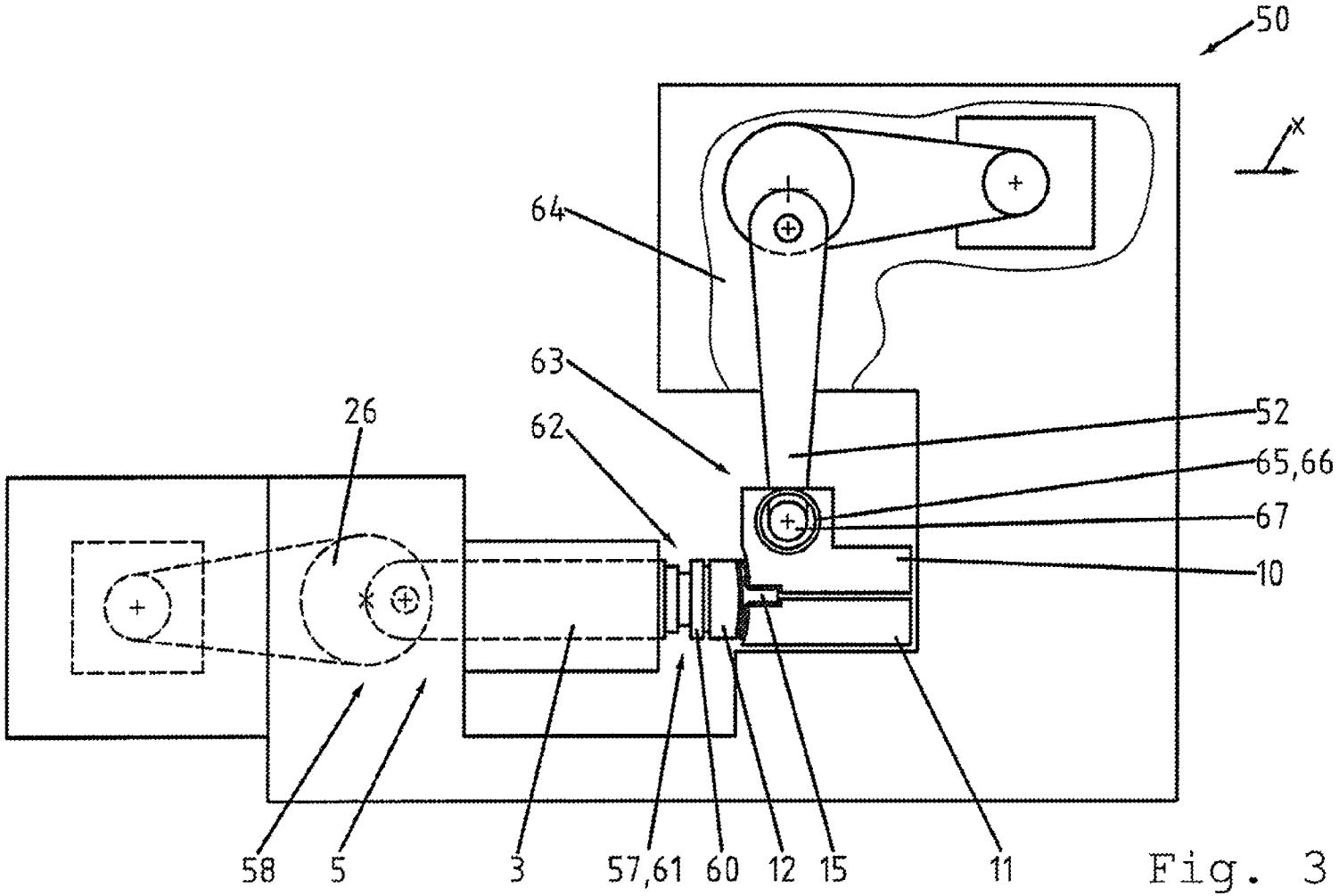
FIGS. 3 to 5 show further schematic side views of the horizontal forging press shown in FIG. 2, wherein the force transmission devices and the forging tool are in different positions.
Figure 4:
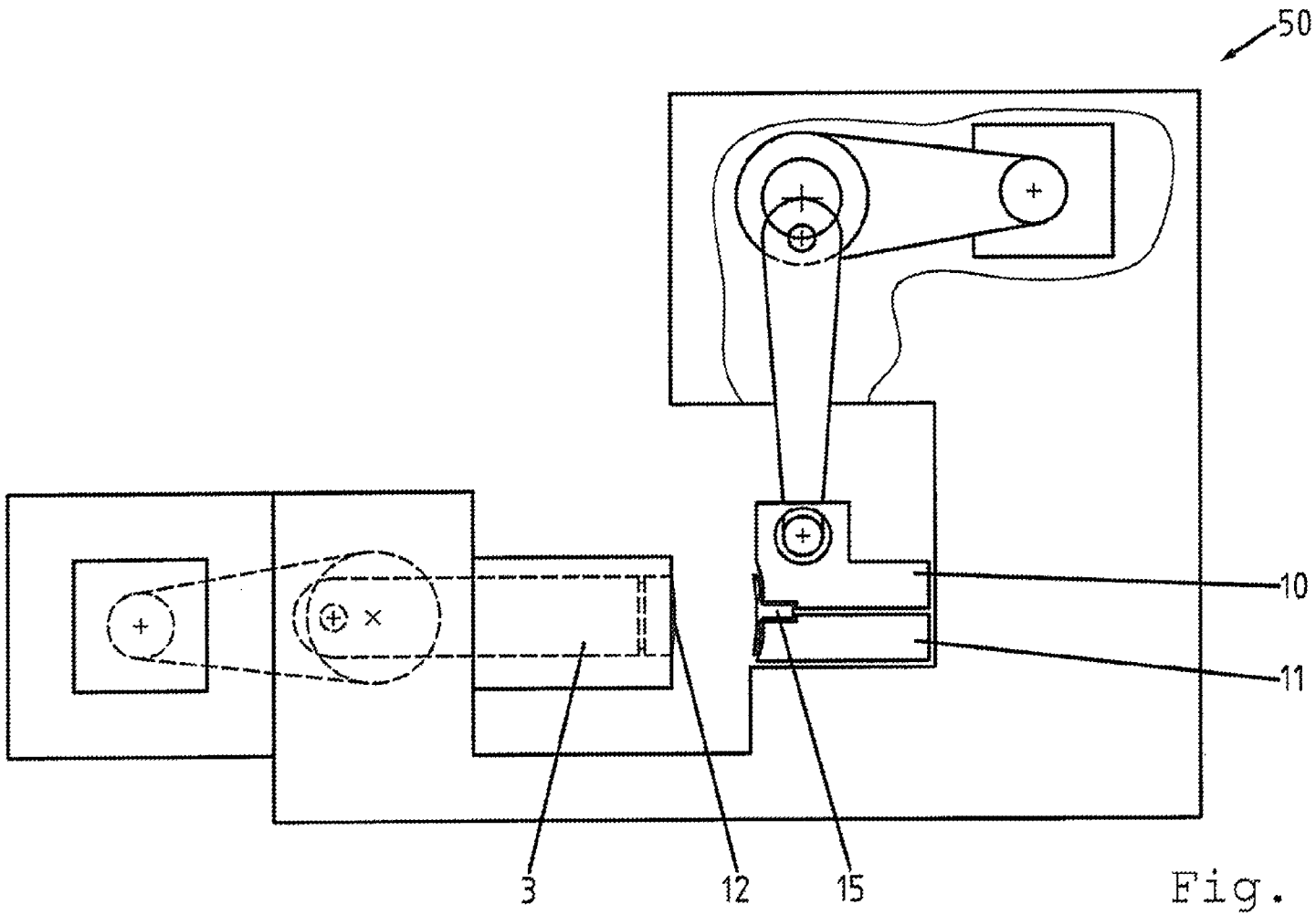

In FIG. 3, the horizontal forging press 50 is shown in a position in which the workpiece 15 clamped by the clamping jaws 10, 11 is already deformed by the forging jaw 12, wherein the forging jaw 12 in the shown position is already fully displaced in the arrow direction x. At variance with the representation of FIG. 2, in FIG. 3 is shown, still schematically, a first spring and/or damping unit 57, which is integrated in a drive train 58 formed by the forging jaw 12, the forging ram 3 and the first force transmission device 5. To this end, the forging ram 3 comprises between a rear end 59, coupled with the crank disk 26, and a front end 60, bearing the forging jaw 12, a center part 62 configured as a hydraulic cushion 61. At variance with the representation of FIG. 2, in FIG. 3 is shown, still schematically, a second spring and/or damping unit 63, which is integrated in a drive train 64 formed by the upper clamping jaw 10, the clamping ram 4 and the second force transmission device 7. The second spring and/or damping unit 63 is here realized as a mechanical spring element 65 in the form of an elastic bearing sleeve 66, in which the rod 52 is guided with a bearing journal 67, wherein the fit between the bearing sleeve 65 and the bearing journal 67 of the rod 52 is shown in the schematic representation with exaggerated play in order to be able to clearly differentiate the components. As a result of the first spring and/or damping unit 57, it is possible to protect the first drive train 58 and the workpiece 15 from overload. It is here also provided that the first spring and/or damping unit 57 is adjustable in its working method and, in particular, can also be made rigid and can thus be switched on and off. As a result of the second spring and/or damping unit 63, it is possible to protect the second drive train 64 and the workpiece 15 from overload by the clamping operation. In particular, it is also provided to realize the second spring and/or damping unit 63 so as to be adjustable in its working method, wherein it can also be made rigid and can thus be switched on and off.

Figure 5:
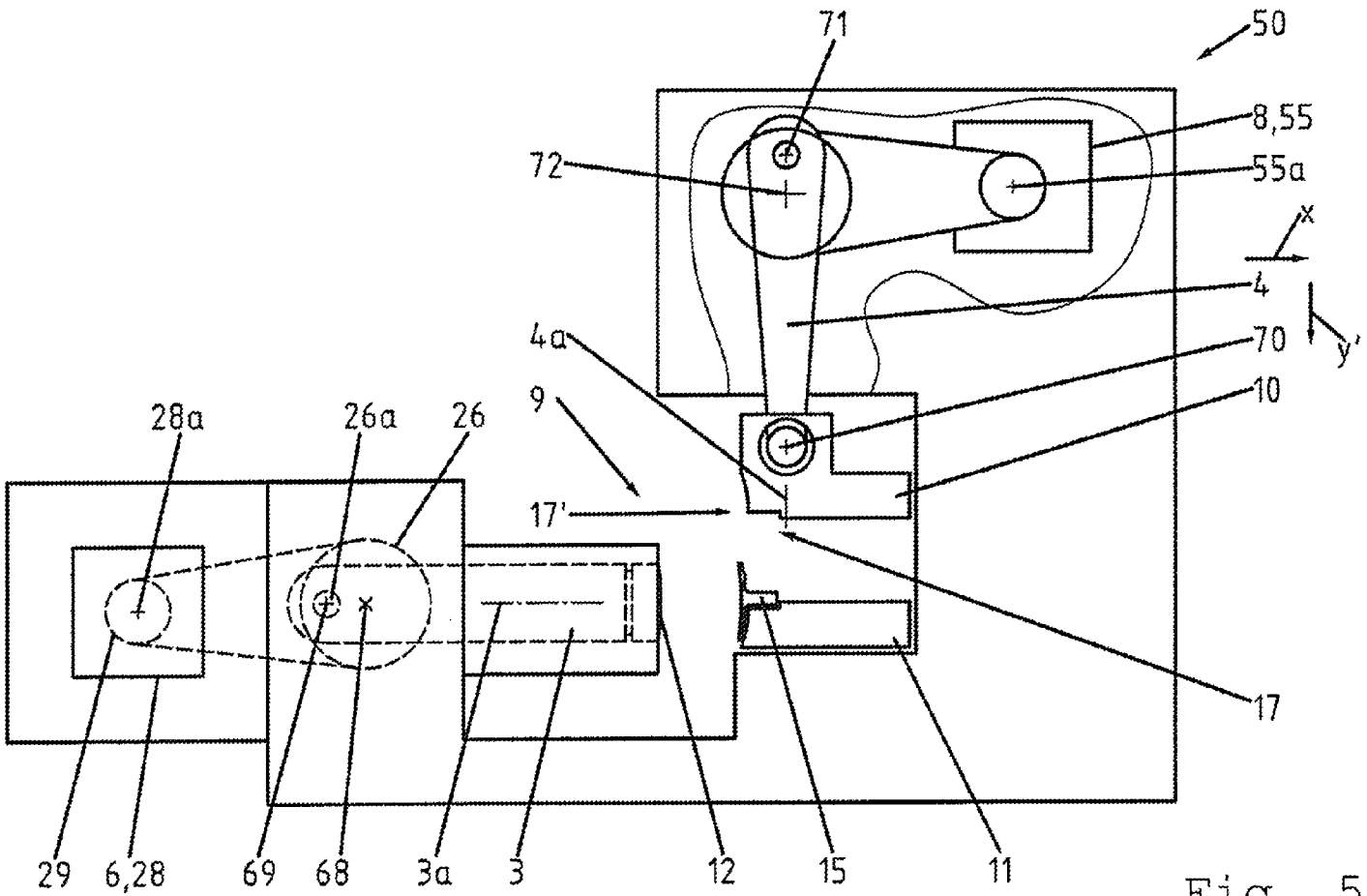

In the workflow of the horizontal forging press 50, which workflow is shown in FIGS. 2 to 5, FIG. 4 shows how the workpiece 15, following deformation by the forging jaw 12, still remains clamped between the clamping jaws 10 and 11 during the return stroke of the forging ram 3. FIG. 5 then shows how the workpiece 15, following the return stroke of the forging ram 3, is released from the clamping jaws 10 and 11 by raising of the upper clamping jaw 10 to allow removal of the forged or upset workpiece 15. The forging tool 9 here has, in addition to the forging location 17, a further forging location 17', which—viewed into the plane of the drawing—lies behind the forging location 17 and in side view is fully concealed thereby. The forging jaw 12 is here designed such that, in a forging blow in the arrow direction x, it acts both on the as yet unforged workpiece 17—as is shown in FIG. 2—and on an already once forged workpiece 17, which has been shifted by an apparatus (not represented) from the first forging location 17 into the second forging location 17'. The already once forged workpiece 17 is held in the second forging location 17', in the forging blow, likewise by the two clamping jaws 10, 11. As a result of the parallel arrangement of the two drive axes 28*a* and 55*a* of the electric servomotors 28 and 55 used as drives 6 and 8, a narrow structure of the horizontal forging press 50 with respect to its width extending into the plane of the drawing is possible, since also the two drive trains 58 and 64 hereby execute their movements in parallel planes lying parallel to the plane of the drawing. Also the further rotational axes 68 to 72, namely the rotational axis 68 of the crank disk 26, the rotational axis 69 of the forging ram 3 on the crankpin 26*a*, the rotational axis 70 of the clamping ram 4 on the upper clamping jaw 10, the rotational axis 71 of the clamping ram 4 on the crankpin 53*a* of the crank disk 53, and the rotational axis 72 of the crank disk 53 are thus oriented parallel to the drive axes 28*a* and 55*a*. A forging axis 3*a*, which runs in the arrow direction x and in which the forging ram 3 moves the forging jaw 12, lies rotated through 90° relative to the drive axis 28*a* of the first drive 6. A clamping axis 4*a*, which runs vertically in the arrow direction y' and in which the upper clamping jaw 10 is moved by the clamping ram 4, runs likewise twisted through 90° relative to the drive axis 28*a* of the first drive 6.

Figure 6:
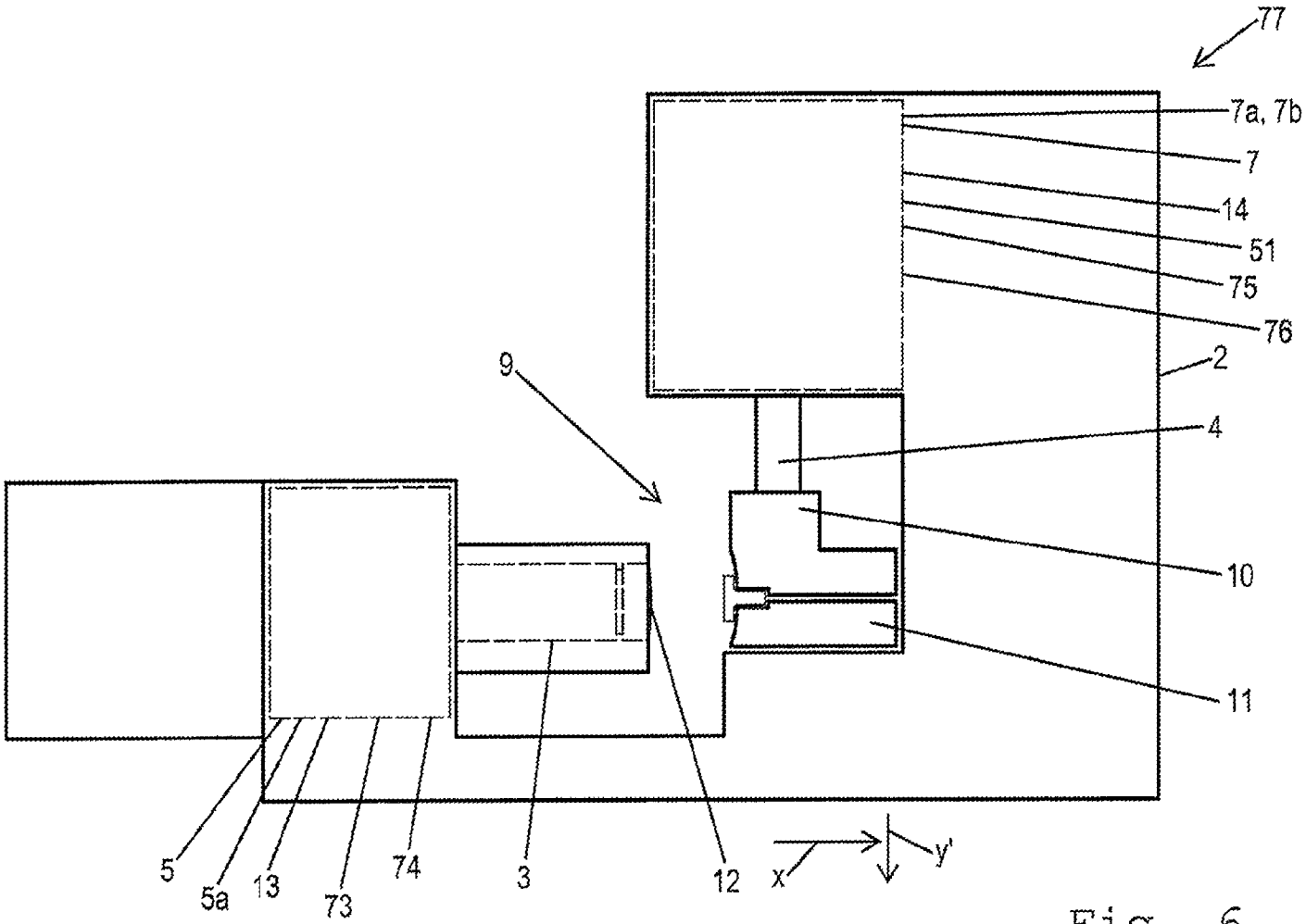
FIG. 6 shows a schematic side view of a third to fourteenth construction variant of a horizontal forging press.

In FIG. 6, further construction variants of a horizontal forging press 77 are shown in schematic side view. In each of these variants, the horizontal forging press 77 comprises a machine frame 2, a forging ram 3 for executing a horizontal forging motion or working motion in an arrow direction x, a clamping ram 4 for executing a vertical clamping motion or working motion in an arrow direction y', a first force transmission device 5 for moving the forging ram 3, a second force transmission device 7 for moving the clamping ram 4, and a multipart forging tool 9. The multipart forging tool 9 is configured as a three-part forging tool 9 having a first, upper clamping jaw 10, a second, lower clamping jaw 11, and a forging jaw 12. The first force transmission device 5 for the forging ram 3 is here configured as a stroke-controlled force transmission device 5*a* and formed, according to choice, by a crank mechanism 13 or a toggle mechanism 73 or an eccentric drive 74. The second force transmission device 7 for the clamping ram 4 is here configured either as an energy-controlled force transmission device 7*b* and formed by a spindle mechanism 14, or is configured as a stroke-controlled force transmission device 7*a* and formed, according to choice, by a crank mechanism 51 or a toggle mechanism 75 or an eccentric drive 76. Accordingly, for the third to fourteenth construction variant of the horizontal forging press 77, those combinations of force transmission devices 5 and 7 which are summarized in the below-situated table are obtained.

| Construction variant | Force transmission device 5 for moving the forging ram 3 | Force transmission device 7 for the clamping ram 4 |
|---|---|---|
| 3 | crank mechanism 13 | crank mechanism 51 |
| 4 | crank mechanism 13 | toggle mechanism 75 |
| 5 | crank mechanism 13 | eccentric drive 76 |
| 6 | crank mechanism 13 | spindle drive 14 |
| 7 | toggle mechanism 73 | crank mechanism 51 |
| 8 | toggle mechanism 73 | toggle mechanism 75 |
| 9 | toggle mechanism 73 | eccentric drive 76 |
| 10 | toggle mechanism 73 | spindle drive 14 |
| 11 | eccentric drive 74 | crank mechanism 51 |
| 12 | eccentric drive 74 | toggle mechanism 75 |
| 13 | eccentric drive 74 | eccentric drive 76 |
| 14 | eccentric drive 74 | spindle drive 14 |

Figure 7:
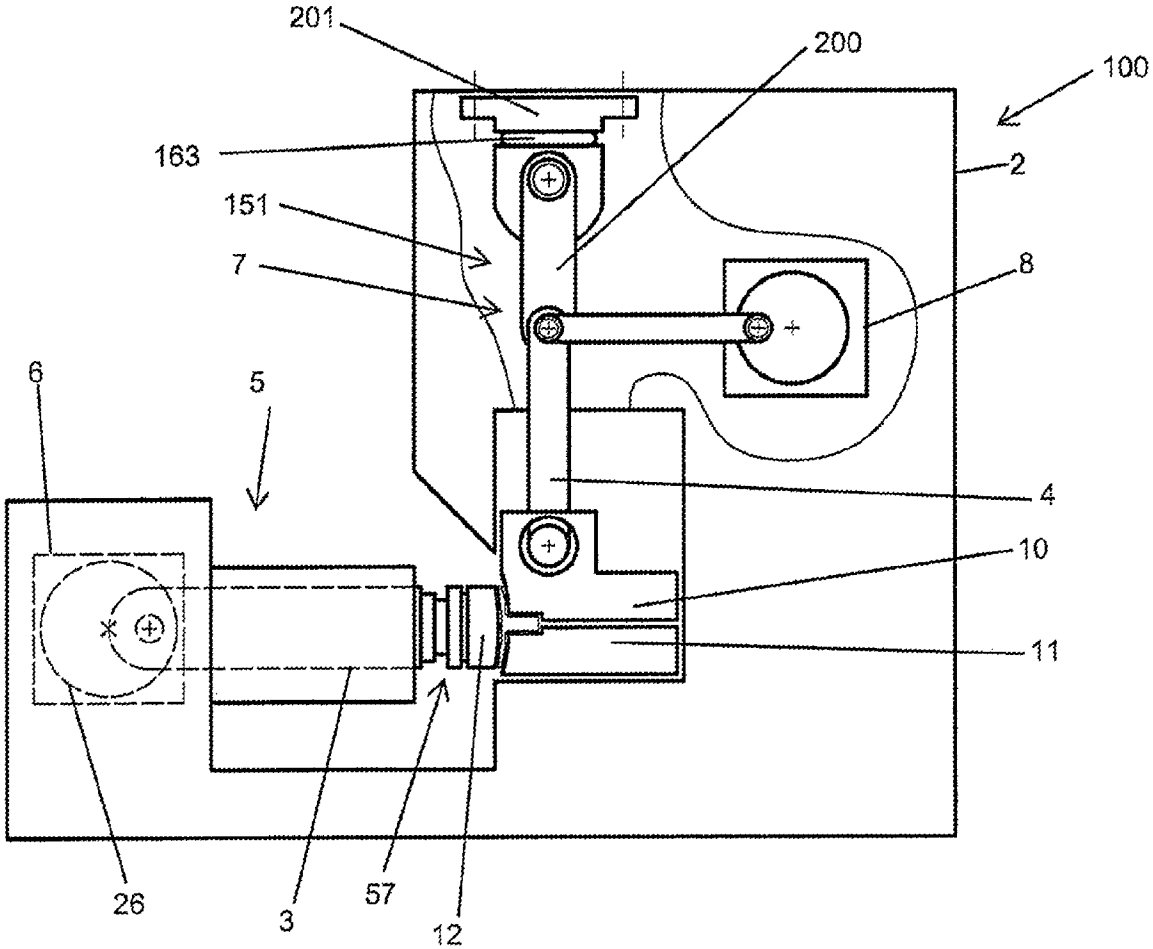
FIGS. 7 and 8 show a schematic side view of a fifteenth and sixteenth construction variant of a horizontal forging press.

In FIG. 7, a schematic side view of a fifteenth construction variant of a horizontal forging press 100 is represented. With respect to the basic structure of the horizontal forging press 100, reference is made to the description pertaining to FIGS. 2 and 3. At variance with the therein shown second construction variant of a horizontal forging press, in the fifteenth construction variant shown in FIG. 7 a crank mechanism 151, which forms the second force transmission device 7, is of modified configuration and comprises a second spring or damping unit 163, which is not disposed between the clamping jaw 10 and the clamping ram 4, but instead is disposed between an auxiliary lever 200 and a counterbearing 201. According to one construction variant, the spring or damping unit 163 comprises a nitrogen cushion. As a result of the altered positioning of the spring or damping unit 163 in relation to the second construction variant, the coupling of the clamping jaw 10 to the clamping ram 4 can be easily realized by mechanical means. In the first force transmission device 5, the drive 6, at variance with the second construction variant, drives the crank disk 26 directly rather than indirectly.

Figure 8:
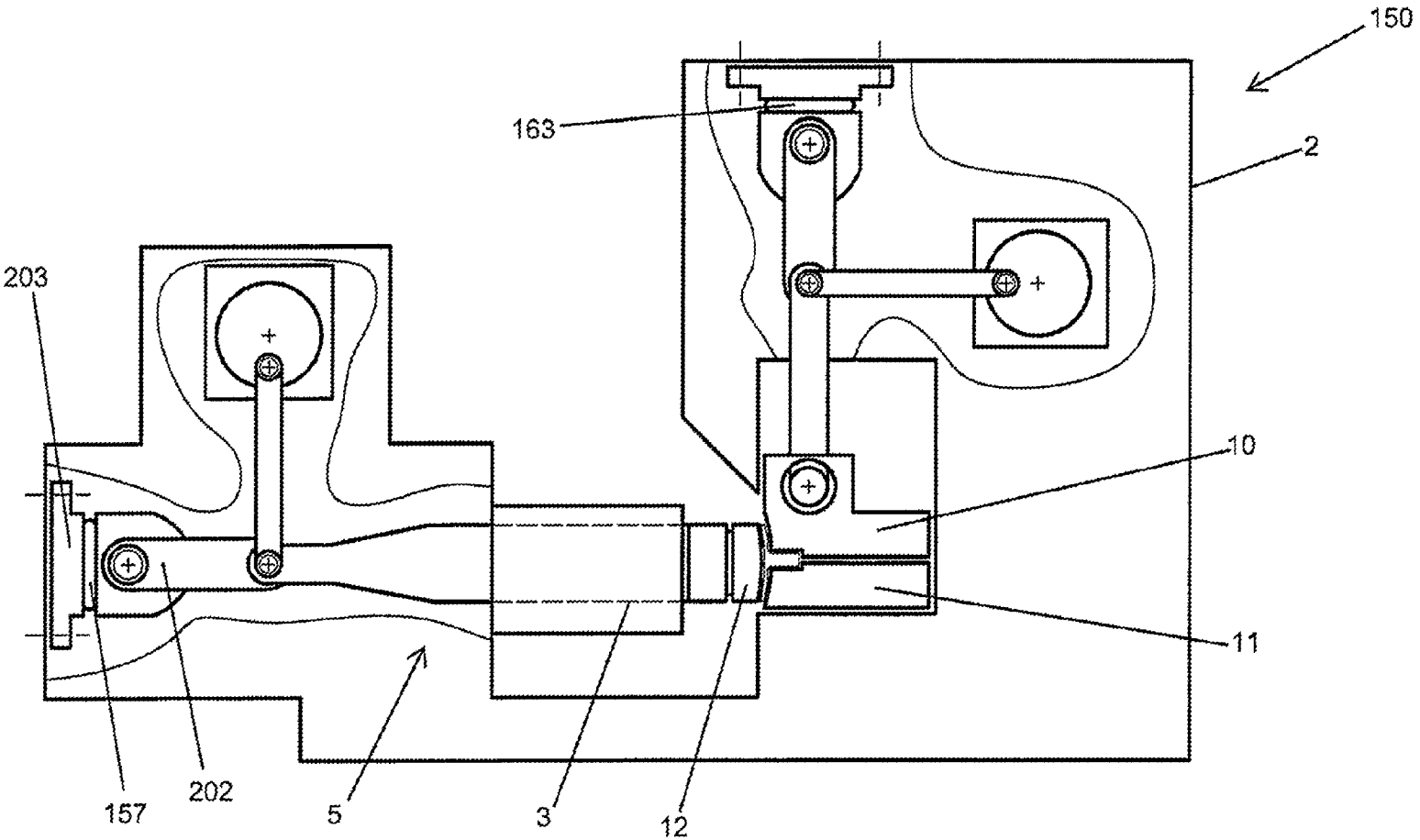

In FIG. 8, a schematic side view of a sixteenth construction variant of a horizontal forging press 150 is represented. With respect to the basic structure of the horizontal forging press 150, reference is made to the description pertaining to FIGS. 2 and 3 and also to FIG. 7. At variance with the horizontal forging press shown in FIG. 7, not only is the second spring or damping unit 163 shifted away from the forging tool 9, but also a first spring or damping unit 157 is disposed between an auxiliary lever 202 and a counterbearing 203, so that the first force transmission device 5 is modified. As a result of this alternative positioning of the first spring or damping unit 157, the forging ram 3, which is guided on the machine frame 2, is particularly insensitive to loads.

The invention is not limited to represented or described illustrative embodiments. Rather, it comprises refinements of the invention within the scope of the patent claims.

REFERENCE SYMBOL LIST

1 horizontal forging press
2 machine frame of 1
3 forging ram
3*a* forging axis
4 clamping ram
4*a* clamping axis
5 first force transmission device
5*a*, 5*b* stroke-controlled force transmission device
6 first drive
7 second force transmission device
7*a* stroke-controlled force transmission device
7*b* energy-controlled force transmission device
8 second drive
9 forging tool
10 first, upper clamping jaw of 9
11 second, lower clamping jaw of 9
12 forging jaw of 9
13 crank mechanism serving as 7
14 spindle mechanism serving as 5
15 workpiece
16 workpiece receiving space
17 first forging location in 9
17' second forging location in 9
18 spindle serving as 4
19 thread of 18
20 toothing on 18
21 spindle nut of 7
22 toothed belt of 7
23 servomotor serving as 8
23*a* drive axis of 23
24 belt pulley on 23
25 rod serving as 3
26 crank disk of 5
26*a* eccentric crankpin
27 belt of 5
28 servomotor serving as 6
28*a* drive axis of 28
29 belt pulley on 28
50 horizontal forging press
51 crank mechanism serving as 5
52 rod serving as 4
53 crank disk of 7*a*
53*a* a eccentric crankpin
54 belt of 7*a*
55 servomotor
55*a* drive axis of 55
56 belt pulley on 55
57 first spring and/or damping unit
58 first drive train
59 rear end of 3
60 front end of 3
61 hydraulic cushion
62 center part of 3
63 second spring and/or damping unit
64 second drive train
65 mechanical spring element
66 bearing sleeve on 10
67 bearing journal of 4
68-72 rotational axis
73 toggle mechanism serving as 5
74 eccentric drive serving as 5
75 toggle mechanism as 7
76 eccentric drive as 7
77 horizontal forging press
100 horizontal forging press
150 horizontal forging press
200 auxiliary lever
201 counterbearing
202 auxiliary lever
203 counterbearing
x, x' horizontal direction
y, y' vertical direction

The invention claimed is:

1. A horizontal forging press for massive forming comprising:

a machine frame, a forging ram for executing a horizontal forging motion, a clamping ram for executing a clamping motion oriented rotated through 90° relative to the forging motion, at least a first force transmission device for executing the forging motion of the forging ram, at least a second force transmission device for executing the clamping motion of the clamping ram, and a multipart forging tool having a forging jaw that is connected to the forging ram, a first clamping jaw that is connected to the clamping ram and a second clamping jaw that is directly connected to the machine frame such that the first clamping jaw is arranged above or beside the second clamping jaw, wherein each force transmission device comprises at least one drive, wherein the first force transmission device of the forging ram is configured as a stroke-controlled force transmission device selected from one of a crank mechanism, a toggle mechanism, or an eccentric drive, comprising a first spring and/or damping unit, wherein the first spring and/or damping unit is disposed in a drive train acting on the forging law, and wherein the second force transmission device of the clamping ram is configured as a stroke-controlled force transmission device or as an energy-controlled force transmission device.

2. The horizontal forging press as claimed in claim 1, wherein the second force transmission device of the clamping ram is configured as one of a crank mechanism, a toggle mechanism, or an eccentric mechanism, or the second force transmission device of the clamping ram is configured as a spindle mechanism.

3. The horizontal forging press as claimed in claim 2, wherein the second force transmission device of the clamping ram comprises a second spring and/or damping unit, wherein the second spring and/or damping unit is disposed in a drive train acting on the first clamping jaw.

4. The horizontal forging press as claimed in claim 1, wherein a drive axis of a first drive for the first force transmission device is oriented parallel to a drive axis of a second drive for the second force transmission device, wherein these two axes are arranged horizontally and wherein these two axes are respectively arranged rotated through 90° in relation to a forging axis.

5. The horizontal forging press as claimed in claim 4, wherein the first drive comprises at least one servomotor, and/or the second drive comprises at least one servomotor.

6. The horizontal forging press as claimed in claim 1, wherein the multipart forging tool has between the two clamping jaws at least two forging locations, which are successively passed through by a workpiece, wherein the workpiece is formed at each forging location by the forging jaw.

7. The horizontal forging press as claimed in claim 1, wherein the first spring and/or damping unit and/or a second spring and/or damping unit is configured as one of a hydraulic cushion, a pneumatic cushion, or a mechanical spring element.

* * * * *